US008662379B2

(12) United States Patent
Pettersson

(10) Patent No.: US 8,662,379 B2
(45) Date of Patent: Mar. 4, 2014

(54) PACKAGE WITH REINFORCED END ZONES AND METHOD FOR MAKING THE SAME

(75) Inventor: Niklas Pettersson, Sandy (SE)

(73) Assignee: Packsize LLC, Salt Lake City, UT (US)

( * ) Notice: Subject to any disclaimer, the term of this patent is extended or adjusted under 35 U.S.C. 154(b) by 0 days.

(21) Appl. No.: 13/069,428

(22) Filed: Mar. 23, 2011

(65) Prior Publication Data

US 2011/0168603 A1 Jul. 14, 2011

Related U.S. Application Data

(62) Division of application No. 11/909,490, filed as application No. PCT/SE2006/000361 on Mar. 23, 2006, now Pat. No. 7,951,058.

(30) Foreign Application Priority Data

Mar. 24, 2005 (SE) ..... 0500676

(51) Int. Cl.
*B65D 5/06* (2006.01)
*B65D 81/02* (2006.01)

(52) U.S. Cl.
USPC ..... 229/103.2; 206/424; 206/521; 229/163

(58) Field of Classification Search
USPC ..... 229/103.2, 163, 190, 194; 206/424, 206/521; 493/59, 162
See application file for complete search history.

(56) References Cited

U.S. PATENT DOCUMENTS

| | | | | | |
|---|---|---|---|---|---|
| 635,377 | A | * | 10/1899 | Ferrell | 229/194 |
| 1,153,951 | A | | 9/1915 | Plants | |
| 1,221,213 | A | | 4/1917 | Plante | |
| 1,874,705 | A | * | 8/1932 | Levkoff | 229/190 |
| 2,056,093 | A | | 9/1936 | Claff | |
| 2,128,982 | A | | 6/1938 | Bickford | |
| 2,470,174 | A | * | 5/1949 | Lewis et al. | 229/190 |
| 2,593,895 | A | * | 4/1952 | Kohl | 229/163 |
| 2,749,015 | A | * | 6/1956 | Pennebaker | 229/190 |
| 2,829,569 | A | | 8/1958 | Aquilla | |
| 3,160,344 | A | | 12/1964 | Bogren | |
| 3,331,548 | A | * | 7/1967 | Cassidy | 206/424 |
| 3,834,610 | A | * | 9/1974 | Eifrid | 206/521 |
| 4,090,607 | A | * | 5/1978 | McCall | 206/424 |
| 4,396,118 | A | * | 8/1983 | Watson | 206/424 |

(Continued)

FOREIGN PATENT DOCUMENTS

| | | |
|---|---|---|
| DE | 8020235 | 10/1980 |
| GB | 366051 | 4/1930 |

*Primary Examiner* — Gary Elkins
(74) *Attorney, Agent, or Firm* — Young & Thompson

(57) ABSTRACT

A blank-folded box-shaped package includes a top, a bottom opposite the top, two opposite lateral walls (I) connecting the top and the bottom, two opposite ends walls (U) connecting the top and the bottom, and two opposite peripheral shock absorbing end zones (R). Each end zone (R) is defined by one of the opposite end walls and extensions of the top, bottom and two opposite lateral walls. Also, each end zone (R) defines an exposed cavity region with the end walls in a retracted position inwardly of the shock absorbing end zone (R) of doubled material. The package defines a package blank in an unfolded state.

6 Claims, 3 Drawing Sheets

(56) References Cited

U.S. PATENT DOCUMENTS

| | | | | |
|---|---|---|---|---|
| 4,584,818 | A | 4/1986 | Plaskett | |
| 4,656,810 | A | 4/1987 | Plaskett | |
| 4,822,325 | A | 4/1989 | Vossen | |
| 5,102,382 | A | 4/1992 | Center et al. | |
| 5,334,068 | A | 8/1994 | Davis | |
| 5,855,543 | A | 1/1999 | Carbone | |
| 6,032,853 | A * | 3/2000 | Chevalier | 229/163 |
| 2002/0036230 | A1 | 3/2002 | Chevalier et al. | |

* cited by examiner

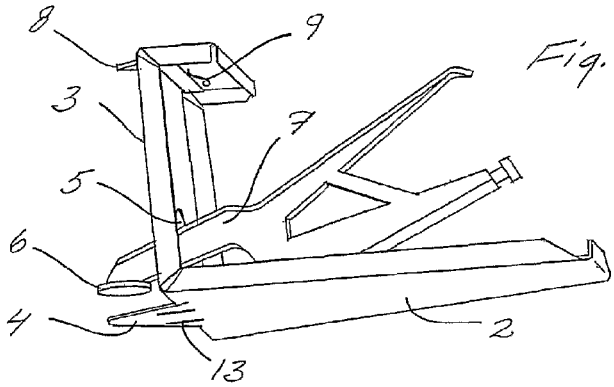
Fig. 4
Fig. 1
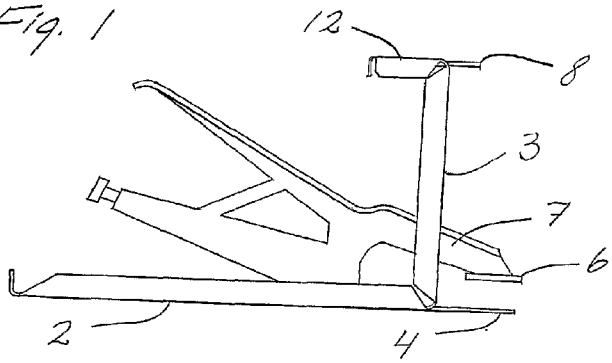
Fig. 3
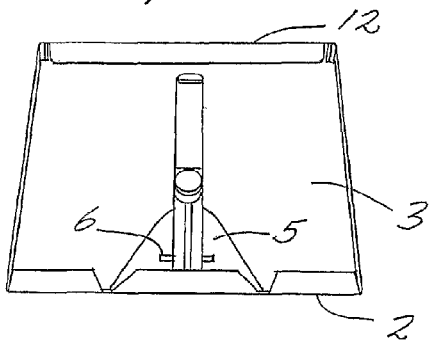
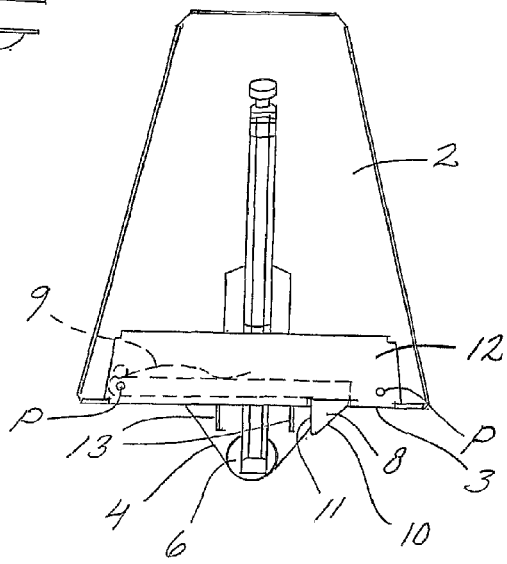
Fig. 2

PACKAGE WITH REINFORCED END ZONES AND METHOD FOR MAKING THE SAME

CROSS REFERENCE TO RELATED APPLICATIONS

This application is a new Divisional of co-pending application Ser. No. 11/909,490 filed on Sep. 24, 2007, which is the 35 U.S.C. §371 national stage of International PCT/SE06/00361 filed on Mar. 23, 2006, which claims priority to Swedish Application No. 0500676-2 filed on Mar. 24, 2005. The entire contents of each of the above-identified applications are hereby incorporated by reference.

BACKGROUND OF THE INVENTION

The invention concerns a package having at least one reinforced end zone, and a method for making the same. The package may advantageously be formed manually from a package blank by use of a tool specifically designed for this purpose.

DESCRIPTION OF THE RELATED ART

In the manual folding of package blanks in order to produce a box shaped package designed with a reinforced protective zone in one or both ends of the package, additional folds are required to achieve a zone of double layers of material. During the folding operation there is a need to temporarily hold the package blank in a partly folded position. A tool for this purpose must allow simple holding and release of the package blank.

A tool suitable for producing the package of the present invention preferably has means that can be activated to temporarily clamp a package blank bottom down against a work surface, and means that can be activated to support part of the package blank in a position erected from the work surface during the insertion of products into the package before the package is finally closed.

BRIEF SUMMARY OF THE INVENTION

To this purpose, the tool may be designed with a bottom plate having a support wall or abutment erect from the front edge of the bottom plate, a tongue protruding in front of the support wall from the front edge of the bottom plate, and a jaw acting from above against the tongue, as well as a spring loaded and back-springing lip protruding in front of the support wall and retractable against the spring force in dependence of the fact that during folding a part of a package blank is made to pass by the lip, and then springs back to support the package blank in the attained folded position.

BRIEF DESCRIPTION OF THE DRAWINGS

The invention will be described in more detail below with reference to the enclosed drawings, wherein FIG. 1 shows a tool in a lateral elevation view;

FIG. 2 shows the tool in a top elevation view;

FIG. 3 shows the tool in a rear elevation view;

FIG. 4 shows the tool in an oblique bottom/rear perspective view;

DESCRIPTION OF THE PREFERRED EMBODIMENTS

Figure 6A:
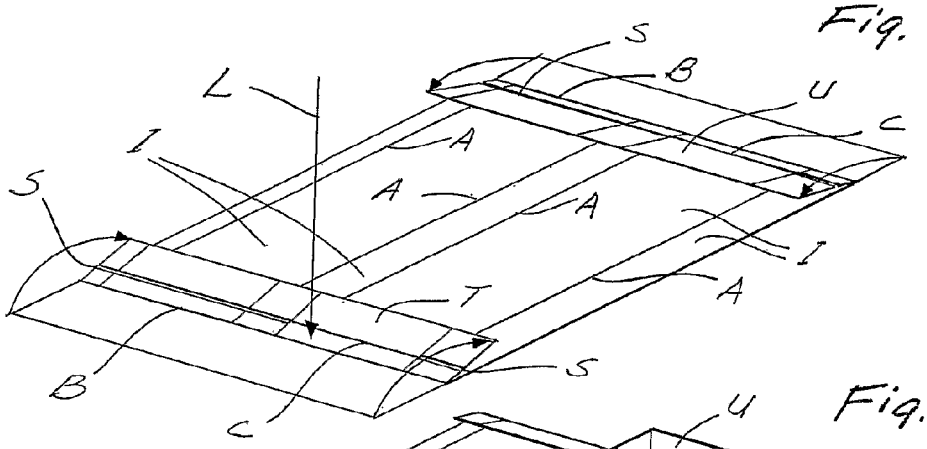
FIGS. 6*a*-6*d* show successive steps in the procedure of folding a package blank in order to prepare a package having reinforced end zones, utilizing the tool illustrated in FIGS. 1-5.
Figure 6B:
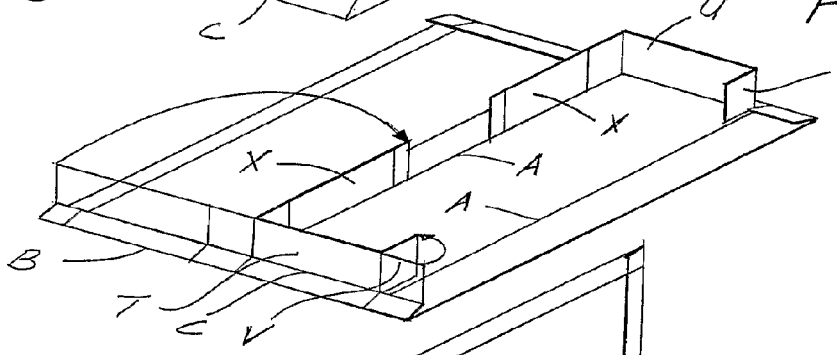

Referring to FIG. 6*a*, a package blank is shown wherein slits and fold lines have been introduced in a planar initial format for folding the blank into a box shaped package. Thus, the package blank comprises three or more longitudinal fold lines A defining the lateral walls I, top, and bottom of the package, the fold lines A forming the corner edges of the completed package when the package blank has been folded into a box shaped package. In at least one, preferably in both ends of the package blank, two fold lines B and C extend transversally to said first longitudinal fold lines A. The inner transverse fold line B forms an end edge of the completed package. The outer fold line C, which extends through one of the top or bottom portions of the package blank only and outside said portion transforms in slits S, forms the connection of the end wall T, U to the peripheral end zone R of doubled material that is formed by folding the blank along the fold line B. In this manner, a package having a protective zone in its end is formed, whereby the end walls obtains a retracted position inwardly of a shock absorbing end zone R made from doubled material. In order to fully understand the design of the completed package, reference is made to the series of pictures in FIGS. 6*a*-6*d*.

Referring to FIGS. 1-4 a tool is shown, designed for manually folding a package blank of the type described above.

The tool 1 comprises a bottom plate 2, having on one of its, henceforth considered front edges an erect abutment 3, in the embodiment shown formed as a supporting wall 3 that extends substantially vertically erected. From the front edge of the bottom plate 2 a tongue 4 projects in front of the supporting wall or abutment 3. Through an opening 5, formed in the abutment or supporting wall 3 and in the embodiment shown delimited by the front edge of the bottom plate, a jaw 6 extends through the supporting wall above the tongue. The jaw 6 is movably arranged and can be activated for temporary clamping of the protective zone of the package blank in the gap between the tongue 4 and the jaw. For this purpose, the jaw is suitably supported in the tip of a leg 7 mounted on the bottom plate and extending through the opening 5. The jaw 6 and the leg 7 may advantageously form parts of a pair of grab tongs of a welding gun mounted on the bottom plate, e.g. by welding or bolts. Preferably, the leg is provided with a release mechanism for single handed activation of a kind known per se from commercially available grab tongs, such as the grab tongs manufactured by Danish company Scangrip A/S.

A lip 8 is arranged in the support wall 3 and movable between a position protruding in front of the support wall and a position retracted inside of or into the support wall. The lip is biased to the protruding position by a spring means 9 and retractable against the action of the spring means as a function of the fact that a part of the package blank during a folding operation is made to pass the lip. The protruding part of the lip 8 is delimited on one side by an edge 10 that is tilted in relation to the support wall 3 and, in the tip of the lip, transforms into an edge 11 that is substantially perpendicular to the support wall and forms the other side of the lip 8. Since part of the package blank is erected from the support in the folding operation, by folding along a fold line A, and is made to pass substantially parallel to the supporting wall in the direction of said tilted edge, the lip is pushed away by the package blank passing the lip and then held in the erected position, supported against the perpendicularly upright edge of the lip, now springing back and protruding.

The bottom plate 2, tongue 4, and vertical supporting wall 3 of the tool can be prepared from one single piece, such as from a plate of steel, whereby the front edge of the bottom plate is made by bending in a line running between the bottom plate 2 and the supporting wall 3, and the tongue 4 is integrally formed by an opening 5 being cut out of the supporting wall. The lip 8 and the spring means 9 are suitably arranged on the underside of an upper end area 12 of the supporting wall 3, being bent backwards. In FIG. 2, a broken line illustrates the spring means 9 in the form of a torsion spring, pin spring or leaf spring 9, the spring means pre-stressing and thereby loading an arm in one end mounted pivotably at P and in the opposite end formed with the lip 8. In this connection it is to be noted that the tool shown may be arranged for simple switching between left hand position and right hand position, by alternative mounting positions P, P' for the lip 8 and the spring 9, and double slits for penetration of the lip 8 through the support wall 3 (as illustrated in FIG. 2).

Reference is now made to FIG. 5 and FIGS. 6*a*-6*d* for the use and function of the tool.

In a first operation for the completion of a box shaped package, the package blank is folded in accordance with FIG. 6*a* in the inner fold line B extending transversally over the width of the package blank. The protective zone thus folded in double is inserted against the abutment or support wall 3 into the gap between the jaw 6 and the tongue 4, where after the jaw is activated to hold the protective zone of the package blank by clamping against the tongue 4 in the direction of the arrow L in FIG. 6*a*. In this first support position, illustrated in FIG. 5 with the package blank shown in a broken single-dot line, the package blank is held in order to facilitate the other operations during folding, such as the subsequent folds in the opposite end of the package blank.

In this connection it is to be pointed out that the jaw 6 preferably has a length protrading outside of the supporting wall and adapted to the distance between the fold lines B and C, said distance forming the height or width of the protective zone of doubled material in the end of the package. It is further advised that the tongue 4 should comprise a mark, e.g. in the form of a slit 13 in the longitudinal direction of the tongue, towards which mark a fold line A can be oriented when the package blank is inserted into the tool for supporting contact against the abutment/supporting wall 3.

In the next operation, the end walls T, U of the package are erected by folding along fold lines C. The free-cut extensions X, V of the end walls are thereafter folded inwards in the direction of the respective fold lines A which form the corners of the finished package, in the direction towards the axial center of the package blank. After that folding, the extended portions X, V of the end walls will extend supportively inside of and adjacent opposite lateral walls of the completed package. With this operation, the package blank has adopted the position shown in FIG. 6*b*.

Figure 5:
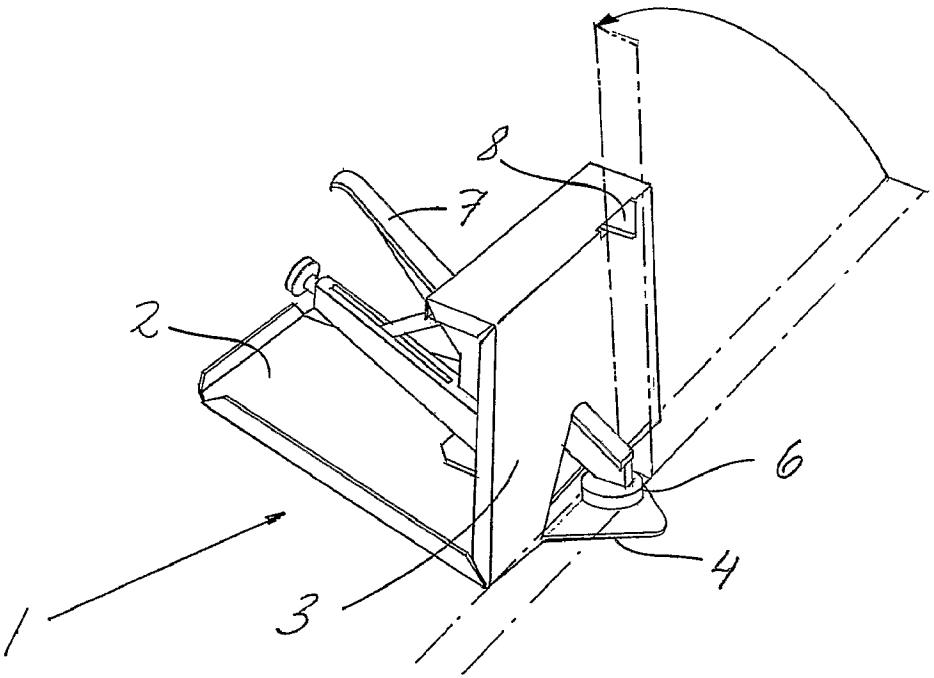
FIG. 5 shows the tool according to the invention in an oblique top/front perspective view.
Figure 6C:
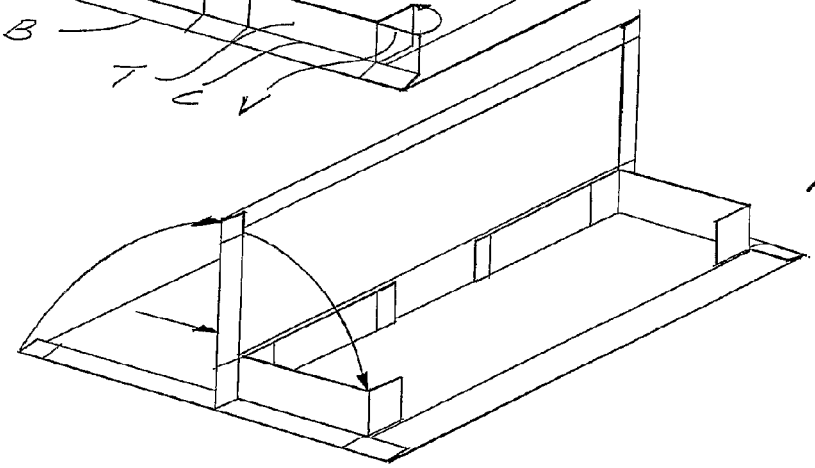

Thereafter, folding along fold line A is performed to erect a first lateral wall positioned outside of the tool grip on the farthermost side of the tool, viewed from the position of the operator. This folding is performed so that the doubled rim, and more specifically that part thereof which forms an extension of the lateral wall connecting in said fold line A to the bottom portion held by the tool, during the erection operation passes the lip 8 and is thereby held temporarily in the upright position as shown in FIG. 6*c*. In FIG. 5, this second supported position is illustrated with the package blank shown in a double-dot broken line.

In the second supported position, in which the tool aided by the lip 8 temporarily holds the package blank in an open condition with the top portion of the package blank standing in an upright position, products can easily be put into the open package. The erected sections of the package blank, which is prevented by the lip 8 from falling back onto the work surface, in turn secures the inwardly folded extensions of the end walls T, U, whereby these, too, are locked in their erected positions. Thereby, the operator has both hands free for the insertion of products into a receiving space defined by the bottom, end walls and firstly erected lateral wall, before the package blank is closed by folding along the other fold lines A in order to form a finalized package enclosing the products.

Figure 6D:
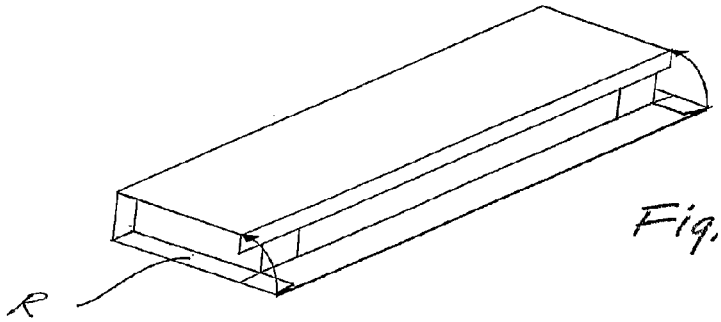

In a final folding operation along the remaining fold lines A, the erected upright wall, referred to as the top portion in the above paragraph, is lowered and the second lateral wall (closest to the operator) is erected to close the package in accordance with FIG. 6*d*. The completely folded package may thereafter be detached from the tool by activating the release mechanism of the jaw.

The primary function of the tool is to form a "third hand" aiding the operator by temporarily fixing the package blank in a partly folded position while both hands of the operator are busy performing the next folding operation or filling the package with products. Therefore, the tool is preferably utilized standing freely on a work table or on a conveyor belt in a production line in order to enable the operator to handle the package blank freely for folding or insertion of products, but may alternatively be fixed on the work table, or integrated into this table by having the bottom plate fitted into the table surface or forming part of said surface. The shown embodiment of the tool is adapted for, and described as utilized in, the folding of a package blank designed to prepare a package having reinforced end zones, said package blank comprising longitudinal fold lines A along which the package blank can be folded to form the lateral walls I of the package, fold lines B, C running transverse to fold lines A and along which the package lank is foldable (B) to form a peripheral protective zone R of double-folded material at the end of the package, and foldable (C) to form the end wall T, U of the package with associated, free-cut extensions V, X, respectively. In this implementation, the tool thus comprises means 4, 6 which can be activated for engagement with the protective zone R for temporary clamping of the package blank bottom down against a work surface, as well as means 8 which can be activated in order to support a part of the package blank in a position erected from the work surface during the insertion of products into the package.

What is claimed is:

1. A planar format package blank having slits and fold lines along which the package blank is to be folded to form a box shaped package having a top, a bottom opposite the top and two opposite lateral walls connecting the top and the bottom, the package blank further comprising:

longitudinal fold lines connecting the top and the bottom with lateral walls on each side of the bottom, a first transverse fold line in each end of the package blank extending through the top, the bottom and the lateral walls, a second transverse fold line in each end of the package blank extending through the bottom only, the second transverse fold line located longitudinally outside of the first transverse fold line in an unfolded state of the package blank, portions of the top, the bottom and the lateral walls producing a shock absorbing package end of double-layered material by folding the package blank double along the first transverse fold line, thus forming an end edge of the package, a portion of the bottom producing an end wall of single-layered material by raising the double-folded package blank along the second transverse fold line, wherein slits made in continuation of the second transverse fold line through the top and lateral walls and not through the bottom define extension portions foldable to extend supportively from both laterally facing ends of the single-layered end wall, one inside of each opposite lateral wall in the folded package, the package blank upon folding thus producing shock absorbing package ends wherein the end wall and double-layered portions of the top, the bottom and the lateral walls are structurally interlocked without bonding means.

2. The package blank of claim 1, wherein the package blank is of rectangular format without portions being cut-out therefrom.

3. A box-shaped package, in an unfolded state defining a planar format package blank, the package comprising:

a top;

a bottom opposite the top;

two opposite lateral walls connecting the top and the bottom via longitudinal fold lines; and in each end of the package, an end wall connecting the top and the bottom, the end walls located in a retracted position inwardly of a shock absorbing package end respectively, wherein, the package end is a double-layered material produced by folding portions of the top, the bottom and the lateral walls along a first transverse fold line, thus forming an end edge of the package, the end wall is a single-layered material produced by raising a portion of the bottom along a second transverse fold line, the second transverse fold line located longitudinally outside of the first transverse fold line in the unfolded state of the package blank, wherein slits made in continuation of the second transverse fold line through the top and lateral walls and not through the bottom define extension portions which extend folded from both laterally facing ends of the single-layered end wall, one inside of each opposite lateral wall, the package thus having shock absorbing package ends wherein the end wall and double-layered portions of the top, the bottom and the lateral walls are structurally interlocked without bonding means.

4. The box-shaped package of claim 3, wherein the entire package blank of rectangular format, without portions being cut-out therefrom, is included in the box shaped package.

5. A method of forming a box shaped package from a planar format package blank, foldable into a package having a top, a bottom opposite the top and two opposite lateral walls connecting the top and the bottom, and in each end of the package an end wall connecting the top and the bottom, the end walls located in a retracted position inwardly of a shock absorbing package end respectively, the method comprising:

applying longitudinal fold lines defining the top, the bottom and lateral walls on each side of the bottom; and in each end of the package blank:

i) applying a first transverse fold line extended through the top, the bottom and the lateral walls, ii) applying a second transverse fold line extending through the bottom only, the second transverse fold line located longitudinally outside of the first transverse fold line in the unfolded package blank, iii) cutting slits in continuation of the second transverse fold line through the top and the lateral walls and not through the bottom, producing extension portions which extend foldable from both laterally facing ends of the end wall, iv) folding the package blank double along the first transverse fold line, thus forming an end edge of the package while producing a shock absorbing package end of double-layered material including portions of the top, the bottom and the lateral walls, v) raising the double-folded package blank along the second transverse fold line, producing an end wall of single-layered material including a portion of the bottom, and vi) folding the extension portions to extend supportively from both laterally facing ends of the single-layered end wall, one inside of each opposite lateral wall in the folded package, whereby the end wall and double-layered portions of the top, the bottom and the lateral walls are structurally interlocked without bonding means in the shock absorbing package ends.

6. The method of claim 5, comprising using the entire package blank of rectangular format without portions being cut-out therefrom to form the box shaped package.

* * * * *